US008967265B2

(12) United States Patent
Awid et al.

(10) Patent No.: US 8,967,265 B2
(45) Date of Patent: Mar. 3, 2015

(54) FLOW CONTROL APPARATUS

(75) Inventors: Abdurrezagh Awid, Dyce (GB); Annabel Green, Lumsden (GB); Murray Dowsett, Dyce (GB)

(73) Assignee: Weatherford U.K. Limited, Norfolk (GB)

( * ) Notice: Subject to any disclaimer, the term of this patent is extended or adjusted under 35 U.S.C. 154(b) by 360 days.

(21) Appl. No.: 13/187,773

(22) Filed: Jul. 21, 2011

(65) Prior Publication Data

US 2012/0067588 A1 Mar. 22, 2012

(30) Foreign Application Priority Data

Jul. 22, 2010 (GB) ..... 1012268.7

(51) Int. Cl.
*E21B 37/08* (2006.01)
*E21B 43/12* (2006.01)
*E21B 37/00* (2006.01)

(52) U.S. Cl.
CPC ..... *E21B 43/12* (2013.01); *E21B 37/00* (2013.01); *E21B 37/08* (2013.01)
USPC ..... 166/312; 166/311; 166/158

(58) Field of Classification Search
CPC ..... E21B 37/08
USPC ..... 166/304, 387, 56, 311, 157, 158, 227, 166/312, 205
See application file for complete search history.

(56) References Cited

U.S. PATENT DOCUMENTS

| | | | | |
|---|---|---|---|---|
| 2,918,973 | A | 12/1959 | Ozinga | |
| 3,760,878 | A | 9/1973 | Peevey | |
| 2007/0246213 | A1 | 10/2007 | Hailey, Jr. | |
| 2008/0169099 | A1 | 7/2008 | Pensgaard | |
| 2008/0308272 | A1 * | 12/2008 | Thomeer et al. | 166/250.15 |
| 2009/0084556 | A1 | 4/2009 | Richards et al. | |
| 2009/0101342 | A1 | 4/2009 | Gaudette et al. | |
| 2009/0218101 | A1 | 9/2009 | Langlais et al. | |
| 2009/0260815 | A1 | 10/2009 | Malone | |
| 2009/0260835 | A1 | 10/2009 | Malone | |

FOREIGN PATENT DOCUMENTS

| | | |
|---|---|---|
| CN | 101498208 | 8/2009 |
| GB | 2448069 A | 1/2008 |

OTHER PUBLICATIONS

Australian Examination Report, dated Jan. 30, 2013, for Australian application No. 2011205011.

(Continued)

*Primary Examiner* — Cathleen Hutchins

(74) *Attorney, Agent, or Firm* — Wong, Cabello, Lutsch, Rutherford & Brucculeri LLP

(57) ABSTRACT

A flow control apparatus for use in a wellbore comprises a screen, a first inflow control device and a second inflow control device, wherein a fluid inflow path is provided through the screen and from an outer portion to an inner portion of each inflow control device. A method of cleaning a flow control apparatus such as that described above comprises providing in a wellbore a flow control apparatus comprising at least one screen and at least one inflow control device wherein a fluid inflow path is provided through the at least one screen and from an outer portion to an inner portion of the at least one inflow control device, targeting the at least one inflow control device with a treatment fluid and delivering the treatment fluid such that the fluid flows in a reverse direction along the fluid inflow path.

17 Claims, 4 Drawing Sheets

(56) References Cited

OTHER PUBLICATIONS

Canadian Office Action, date Jan. 30, 2013, for Canadian application No. 2,746,901.

Further UKIPO Search Report dated Mar. 22, 2011 received for corresponding GB patent application No. GB1012268.7.

UKIPO Search Report dated Sep. 13, 2010 received for corresponding GB patent application No. GB1012268.7.

* cited by examiner

FLOW CONTROL APPARATUS

CROSS REFERENCE TO RELATED APPLICATIONS

The present application claims priority to United Kingdom Patent Application No. GB1012268.7 filed on Jul. 22, 2010, the contents of which are incorporated herein by reference.

FIELD OF THE INVENTION

This invention relates to a flow control apparatus. More particularly, the invention relates to a flow control apparatus for use in a wellbore and a method of cleaning a flow control apparatus in a wellbore.

BACKGROUND TO THE INVENTION

In unconsolidated formations created for the extraction of oil and gas, horizontal and deviated wells may be provided with integrated sand screens and inflow control device (ICD) completions, such as those described in GB2448069. Such wells are usually drilled using a drilling mud containing solids for bridging purposes and to prevent fluid loss into the formation. Once the well has been drilled, the drilling mud is replaced with a non-damaging fluid, called Drill In Fluid (DIF), which is cleaner than the conventional drilling mud. However, the DIF still contains some solids to form mud cake to prevent fluid loss.

Prior to completing the reservoir section of the wellbore with the ICD screen completions, the DIF is either replaced by or conditioned to a low or zero solids system. If, however, the DIF in the wellbore is not replaced by or conditioned to a low or zero solids system, and the ICD screen completions are lowered into an unconditioned section of mud which contains solids, the ICD screen completions may plug and, as a result, well performance and productivity may be poor or significantly decline. Even if the ICD screen completions are introduced into a conditioned well, screen plugging can occur as a result of mud cake and invaded mud solids flow back.

It is therefore an aim of the present invention to provide a flow control apparatus and method of cleaning the flow control apparatus, which addresses at least some of the aforementioned problems.

SUMMARY OF THE INVENTION

According to a first aspect of the present invention there is provided a method of cleaning a flow control apparatus in a wellbore comprising: providing in a wellbore a flow control apparatus comprising at least one screen and at least one inflow control device wherein a fluid inflow path is provided through the at least one screen and from an outer portion to an inner portion of the at least one inflow control device; targeting the at least one inflow control device with a treatment fluid; and delivering the treatment fluid such that the fluid flows in a reverse direction along the fluid inflow path.

Thus, the treatment fluid may pass through the inflow control device and then through or over the screen and dislodge, dissolve or disperse material on or in the screen. The treatment fluid may be circulated back through another portion of the flow control apparatus, or may flow along an annulus between the apparatus and a surrounding well bore.

The step of targeting the at least one inflow control device may comprise inserting a treatment tool into the wellbore for the delivery of the treatment fluid.

The method may further comprise the step of locating the treatment tool on a locator provided by the flow control apparatus.

According to a second aspect of the present invention there is provided a flow control apparatus for use in a wellbore, the flow control apparatus comprising: a screen; a first inflow control device and a second inflow control device; wherein a fluid inflow path is provided through the screen and from an outer portion to an inner portion of each inflow control device.

A further aspect of the invention comprises circulating treatment fluid from an inner portion to an outer portion of the first inflow control device, along the screen, and then through an outer portion to an inner portion of the second inflow control device.

Embodiments of the second aspect of the invention provide an improved flow control apparatus which facilitates effective cleanup operations since treatment fluid can be directed along the length of the screen from the first inflow control device (ICD) to the second inflow control device. Accordingly, the treatment fluid will tend to be flowed over or through most or all parts of the screen. Furthermore, embodiments of the present invention may be significantly more efficient at removing near wellbore damage and screen plugging than previous apparatus since treatment fluids can more effectively reach areas of the completion in the targeted vicinity of the ICDs. It is noted that, to date, cleaning of a completion had been attempted by simply pressurising a length of the completion. However, as ICDs are designed to choke or restrict flow, this technique does not effectively result in the cleaning of screens provided in the wellbore.

A further advantage of the present invention is that the second ICD can serve as a back-up to the first ICD, should the first ICD become ineffective or inoperable during use.

The first inflow control device may be provided at one end of the screen and the second inflow control device may be provided at the opposite end of the screen. The orientation of the first and second screens may be such that they both face inwardly towards the screen.

The apparatus may comprise one or more further inflow control devices. Screens may be provided between each inflow control device.

The apparatus may further comprise an ICD locator configured for the alignment of a treatment tool to deliver targeted treatment fluid through at least one of the first or second inflow control devices. As such, improved placement of the treatment fluid for use in the flow control apparatus can be achieved. It will be understood that in certain embodiments, a treatment tool can be accurately positioned to straddle the flow control apparatus so that treatment fluid can be forced through an adjacent first ICD before flowing back through the second ICD. In a particular embodiment, the ICD furthest from the surface may be targeted with the treatment tool so that the treatment fluid can flow back through the nearest ICD and up to the surface.

The ICD locator may be constituted by a recess or an inwardly projecting ledge, shoulder or other projection on which the treatment tool can be located. The ICD locator may be retractable or collapsible (for example, by pressure activation or deactivation) so as to allow the treatment tool to pass by. In certain embodiments, the ICD locator may comprise a welding ring, a spring-loaded (e.g. dog) clip, or an inflatable straddle.

Each of the first and second inflow control devices may be provided for reservoir management. For example, the first and/or second ICDs may be configured to limit the inflow of oil, gas or water into the production tubing from the surrounding wellbore formations. Accordingly, the first and/or second ICDs may be of the type described in GB2448069 having an inner member and an outer member with a flow path therebetween and an elastomer member disposed within the outer member and adjacent the flow path, the elastomer member being capable of swelling on contact with an actuating agent to thereby restrict the inflow of oil, gas or water.

The screen may comprise a tube of mesh configured to restrict the flow of solids, such as sand particles, therethough.

The screen may be provided around a base pipe, in a spaced relationship therefrom.

The fluid inflow path may comprise the space between the base pipe and the screen.

The flow control apparatus may further comprise at least one packer or seal configurable to seal the annulus between the apparatus and the surrounding wellbore. The at least one packer or seal may be extendable or expandable to selectively seal the gap between the apparatus and the surrounding wellbore.

In a specific embodiment, a first packer is configured to seal the annulus between the apparatus and the surrounding wellbore in a region above the first ICD and a second packer is configured to seal the annulus between the apparatus and the surrounding wellbore in a region below the second ICD.

According to a third aspect of the present invention there is provided a treatment tool for use with the flow control apparatus according to the second aspect of the invention, the treatment tool comprising: an inlet for treatment fluid to flow into the tool; at least one outlet for treatment fluid to flow out of the tool; and a treatment locator configured for the alignment of the at least one outlet with the first inflow control device of the flow control apparatus.

The treatment locator may comprise a recess or an outwardly projecting flange, shoulder or other projection. The treatment locator may be retractable or collapsible (for example, by pressure activation or deactivation) so as to allow the treatment tool to pass the first inflow control device. In certain embodiments, the treatment locator may comprise a welding ring, a spring-loaded (e.g. dog) clip, or an inflatable straddle.

According to a fourth aspect of the present invention there is provided a system for cleaning a flow control apparatus in a wellbore comprising: the flow control apparatus according to the second aspect of the present invention and the treatment tool according to the third aspect of the present invention.

It will be understood that in embodiments of the first aspect of the invention, the treatment tool employed may be in accordance with the third aspect of the present invention and the optional features described above in relation to both the second and third aspects of the invention may, optionally, be included in the apparatus employed in the method of the first aspect of the invention.

BRIEF DESCRIPTION OF THE DRAWINGS

Certain embodiments of the invention will now be described with reference to the accompanying drawings, in which:

More specifically, FIG. 6A shows a side view of the flow control apparatus;

FIG. 6B shows a view similar to that of FIG. 6A but with the upper half of the apparatus shown in cross-section;

FIG. 6C shows an enlarged cross-sectional view of the first ICD of FIGS. 6A and 6B; and FIG. 6D shows an enlarged cross-sectional view of the second ICD of FIGS. 6A and 6B.

DETAILED DESCRIPTION OF CERTAIN EMBODIMENTS

Figure 1:
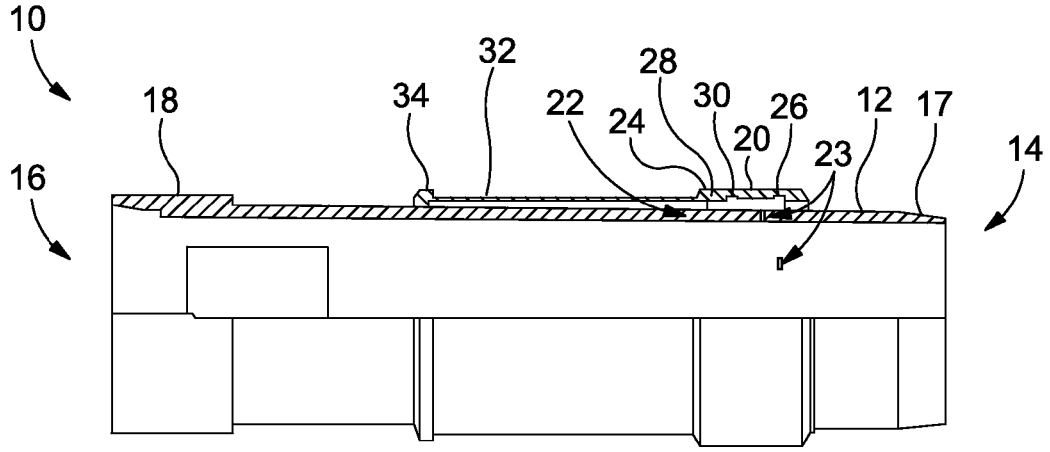
FIG. 1 shows a side view of a known flow control apparatus with the upper half of the device shown in cross-section.

With reference to FIG. 1, there is illustrated a known flow control apparatus 10 comprising a tubular metal base pipe 12 having a first end 14 and a second end 16. A male coupling 17 is provided at the first end and a female coupling 18 is provided at the second end 16 for attachment to further pieces of completion equipment (not shown). Towards the first end 14 there is provided a single inflow control device (ICD) 20 which comprises an inner member 22 constituted by the base pipe 12 and having a series of apertures 23 therein, and an outer member 24 surrounding the inner member 22 and defining part of an inflow path therebetween. A spacer 28 is disposed between the inner member 22 and the outer member 24 and is provided with a series of nozzles 30 therethrough.

Disposed around the base pipe 12 at one end of the ICD 20 is a tubular wire wrap screen 32. The screen 32 surrounds and is spaced from the base pipe 12. In use, a production fluid inflow path 26 extends through the screen 32 into the region between the base pipe 12 and the screen 32. The inflow path then passes through the nozzles 30, between the members 22, 24 and through the apertures 23. Although fluid can flow through the screen 32, sand and other particulates are prevented from passing therethrough and they are therefore prevented from entering the base pipe 12 through the ICD 20.

An end ring 34 is provided at the other end of the screen 32 to secure the screen to the base pipe 12.

In accordance with the first aspect of the invention, the flow control apparatus 10 may be cleaned by targeting and delivering a treatment fluid through the ICD 20 such that it flows in the reverse direction along the inflow path 26, and thus flows along and through the screen 32. The treatment fluid thus dislodges, dissolves or disperses material which may have become adhered to or gathered in or on the screen.

The treatment fluid and any dislodged or dispersed material may be circulated out of the bore, for example passing along the annulus between the apparatus and the surrounding bore wall, passing back through a further ICD, or through some other port or valve.

Figure 2:
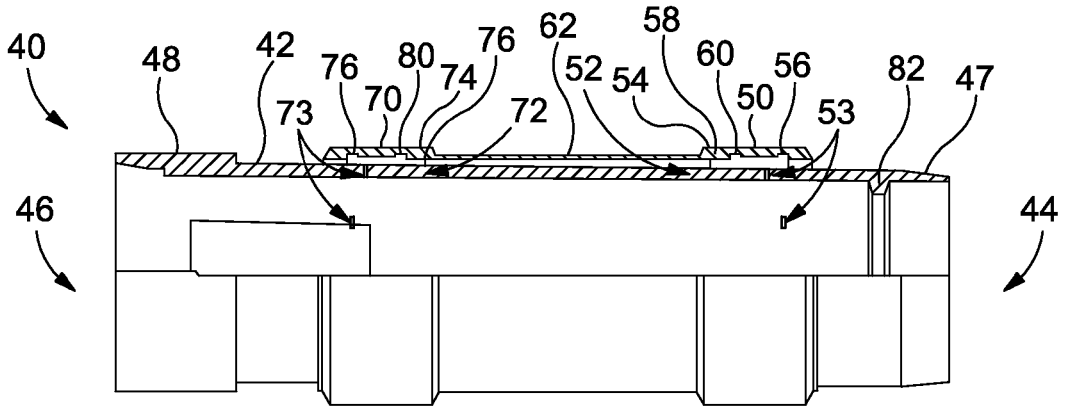
FIG. 2 shows a side view of a flow control apparatus according to an embodiment of the present invention, with the upper half of the device shown in cross-section.

FIG. 2 illustrates a flow control apparatus 40 according to an embodiment of the second aspect of the present invention. As above, the flow control apparatus 40 comprises a tubular metal base pipe 42 having a first end 44 and a second end 46. Couplings 47, 48 are provided at the base pipe ends 44, 46 for attachment to adjacent elements of the completion. Towards the first end 44 there is provided a first inflow control device (ICD) 50 which comprises an inner member 52 constituted by the base pipe 42 and having a series of apertures 53 therein, and an outer member 54 surrounding the inner member 52 and defining an inflow path 56 therebetween. A spacer 58 is disposed between the inner member 52 and the outer member 54 and is provided with a series of nozzles 60 therethrough.

Also as described above in relation to FIG. 1, a tubular wire wrap screen 62 is disposed around and spaced from the base pipe 42, adjacent one end of the ICD 50. However, in accordance with an embodiment of the second aspect of the present invention, a second ICD 70 is provided at the other end of the screen 62. The second ICD 70 is identical to the first ICD 50 but is orientated in an opposite direction when compared to the first ICD 50 so as to provide a mirror image thereof when viewed from the side as per FIG. 2. Accordingly, the second ICD 70 comprises an inner member 72 constituted by the base pipe 42 and having a series of apertures 73 therein, and an outer member 74 surrounding the inner member 72 and defining an inflow path 76 therebetween. A spacer 78 is disposed between the inner member 72 and the outer member 74 and is provided with a series of nozzles 80 therethrough.

While a wellbore is producing, production fluid will flow through the screen 62, along the annulus between the screen 62 and the base pipe 42, through the nozzles 60, 80, between the inner and outer members 52, 72, and 54, 74, and through the apertures 53, 73 and into the base pipe 42. The production fluid will then flow to surface, co-mingling with production fluid which has passed through other ICDs at other locations on the completion.

An ICD locator in the form of a collapsible inwardly projecting annular ledge 82 is provided on the inner surface of the base pipe 42 between the first end 44 and the first ICD 50.

Figure 3:
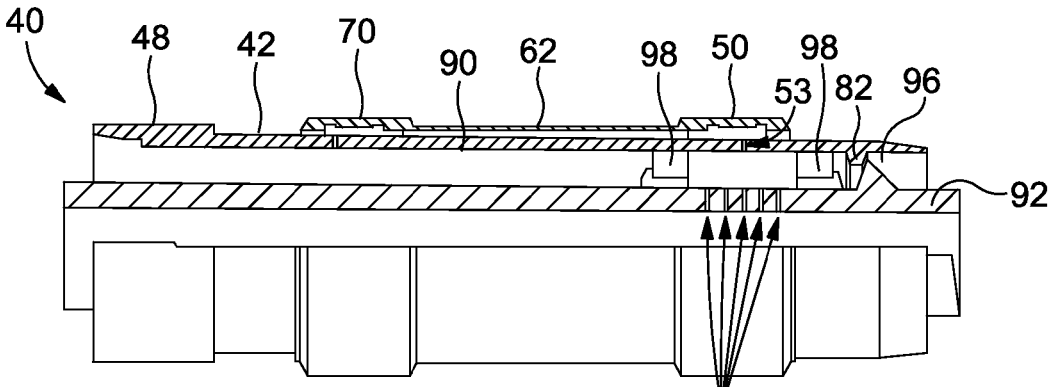
FIG. 3 shows a view similar to that shown in FIG. 2 but with a treatment tool in place.
Figure 4:
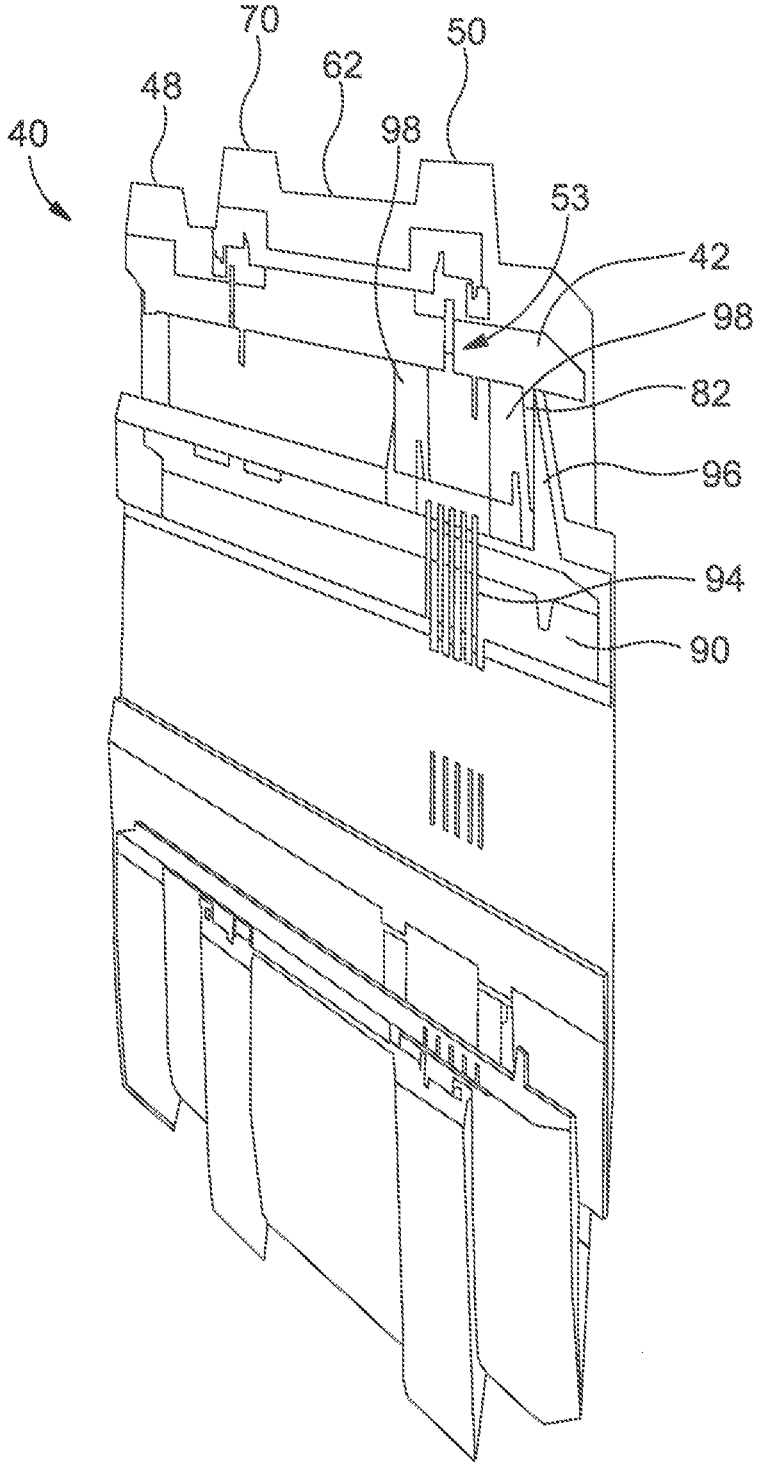
FIG. 4 shows an enlarged perspective view of the apparatus shown in FIG. 3.

FIGS. 3 and 4 illustrate the flow control apparatus 40 of FIG. 2 with a treatment tool 90 according to an embodiment of the third aspect of the present invention, located for a cleaning operation which will typically be carried out after a completion incorporating the apparatus 40 has been run into and set in the wellbore. The treatment tool 90 comprises a cylindrical support 92 having a series of five radial jetting nozzles 94 arranged to allow fluid to flow from an interior of the support 92 to an exterior of the support 92. The treatment tool 90 also comprises a treatment locator (or stop shoulder) in the form of an annular outwardly radially projecting flange 96 configured to abut the corresponding ledge 82 of the flow control apparatus 40 to thereby align the jetting nozzles 94 with the first ICD 50.

First and second expandable annular sealing elements 98 are provided between the treatment tool 90 and the flow control apparatus 40, to ensure fluid flow from the series of jetting nozzles 94 is directed through the apertures 53 and into the first ICD 50. It will be understood that in order to arrive at the position shown in FIG. 3, the ICD locator 82 must either be collapsed to allow the treatment tool 90 and expanded sealing elements 98 to pass by or the sealing elements 98 themselves must be collapsed and only expanded when the treatment tool 90 is in position.

Figures 5A, 5B, 5C:
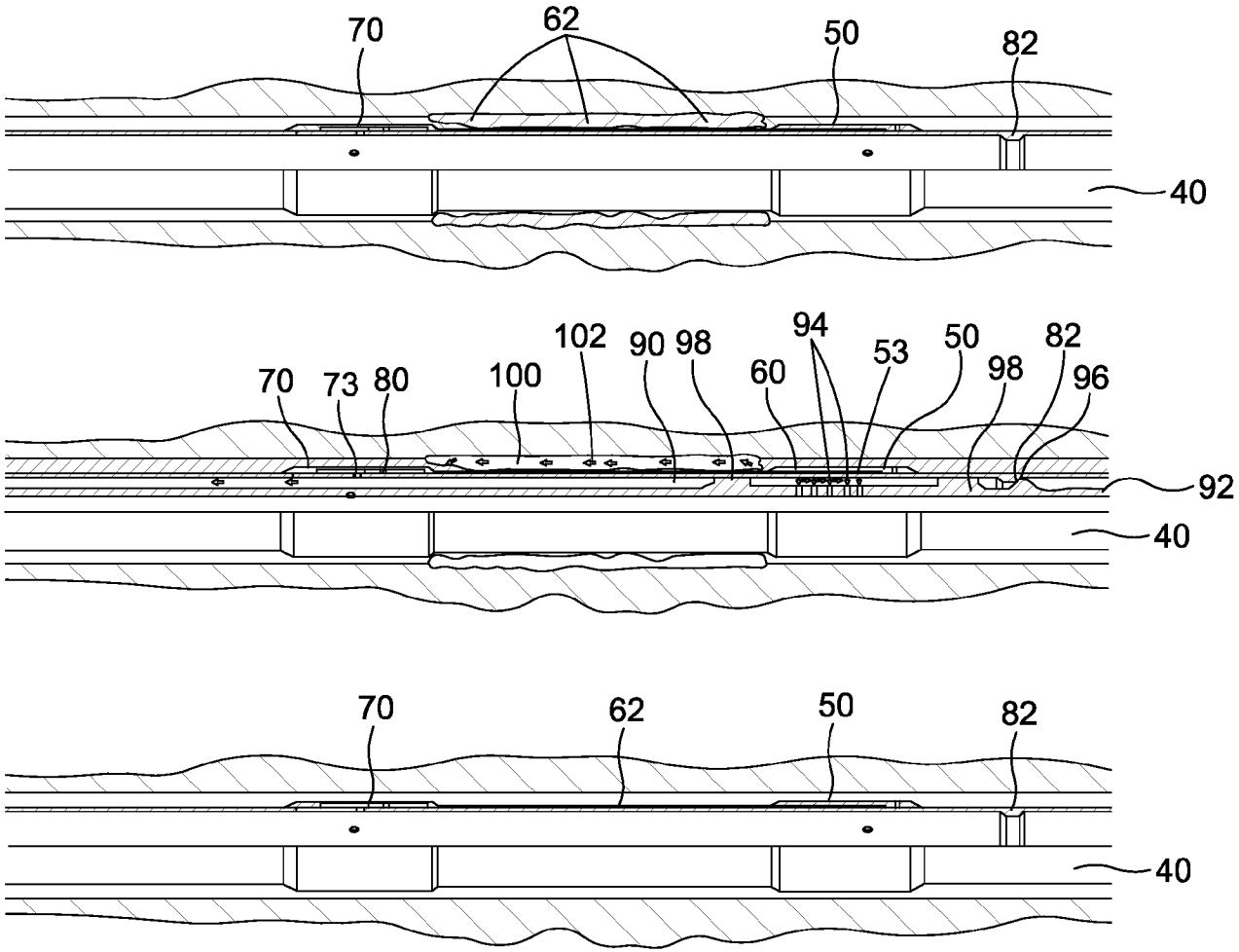
FIG. 5A shows a view similar to that shown in FIG. 2, wherein the screen is plugged with mud prior to treatment.
FIG. 5B shows a view similar to that shown in FIG. 3, during treatment of the screen.
FIG. 5C shows a view similar to that shown in FIG. 5A, after the screen has been treated.

FIG. 5A shows a view similar to that shown in FIG. 2, wherein the screen 62 of the flow control apparatus 40 is plugged with mud prior to a cleaning treatment. FIG. 5B shows a view similar to that shown in FIGS. 3 and 4, with the treatment tool 90 located within the flow control apparatus 40 (by engagement of the flange 96 with the ledge 82) and with fluid treatment being dispensed from the treatment tool 90 to clean the screen 62. Accordingly, it can be seen that treatment fluid 100, which in this case is a mixture of water with surfactants, anticoagulants and the like, is introduced via the treatment tool 90 and is dispensed through the jetting nozzles 94 into a chamber defined by the sealing elements 98 and then into the first ICD 50 through apertures 53. The treatment fluid 100 then flows through the nozzles 60 to the exterior of the ICD 50 before flowing along the length of the screen 62 to dislodge, dissolve or disperse the mud and other solids plugging the screen 62 and disperse these materials in the treatment fluid before it enters the second ICD 70 through the nozzles 80 and returns to the interior of the flow control apparatus 40 via the apertures 73. Accordingly the treatment fluid 100 is encouraged to flow along a treatment fluid flow path 102 from the interior to the exterior of the first ICD 50, along the length of the screen 62, and from the exterior to the interior of the second ICD 70. As such, the present invention provides an improved apparatus for the efficient cleaning of an ICD screen completion.

FIG. 5C shows a view similar to that shown in FIG. 5A, after the fluid treatment has been completed and the treatment tool 90 has been removed. Thus, it can be seen that the screen 62 is no longer plugged with mud and the cleaning operation has been successful.

FIGS. 6A to 6D show a flow control apparatus 100 according to another embodiment of the present invention. The flow control apparatus 100 is similar to that shown in FIGS. 2 through 5C and so like reference numerals will be used where appropriate. Thus, the flow control apparatus 100 comprises a tubular metal base pipe 42 having a first inflow control device (ICD) 102 and a second inflow control device (ICD) 104 provided at opposite ends of a tubular wire wrap screen 62 disposed around the base pipe 42. Although only the ends of the screen 62 are specifically depicted in FIGS. 6A and 6D, it will be noted that the screen 62 is continuous between the first and second ICDs 102, 104.

Figure 6A:
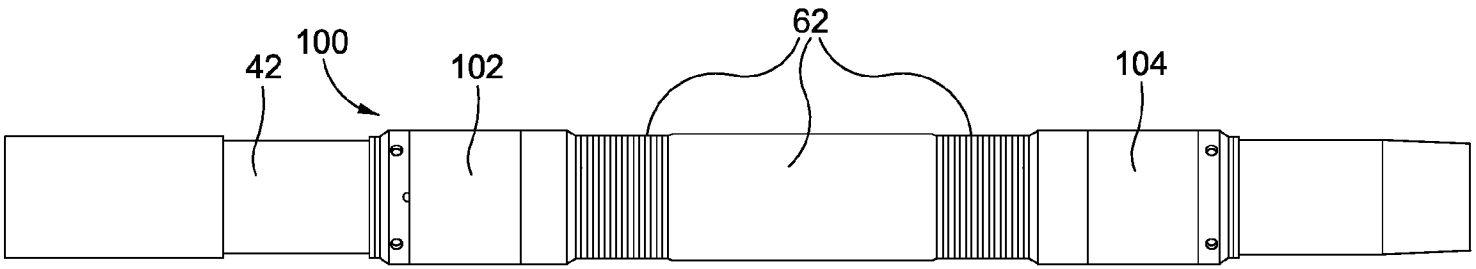
FIGS. 6A to 6D show a flow control apparatus according to a further embodiment of the present invention, that is similar to that shown in FIGS. 2 through 5C, but showing the inflow control devices (ICDs) in greater detail.
Figure 6D:
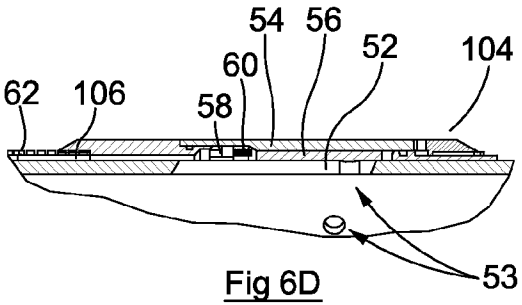
Figure 6C:
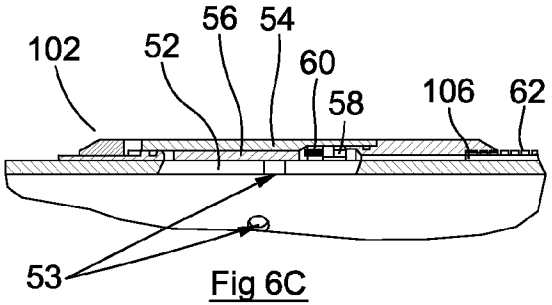
Figure 6B:
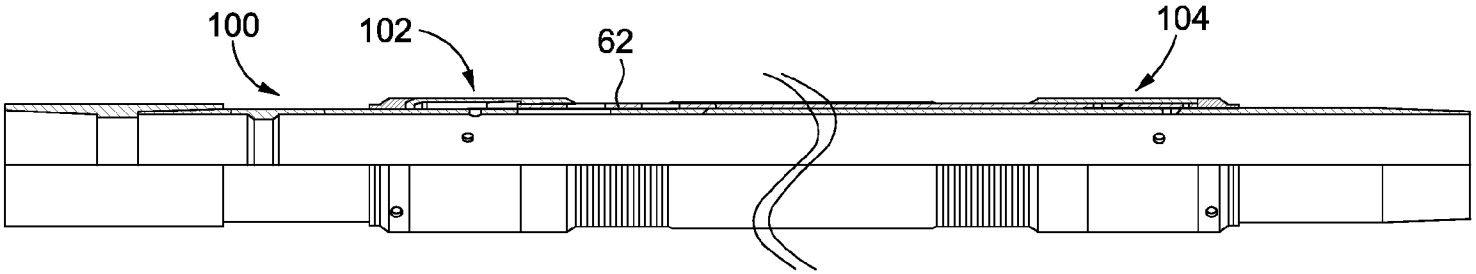

As best shown in FIGS. 6C and 6D, the first and second ICD's 102, 104 are identical but are orientated so that they each face inwardly towards the screen 62. Each ICD 102, 104 comprises a inner member 52 constituted by the base pipe 42 and having a series of apertures 53 therein, and an outer member 54 surrounding the inner member 52 and defining an inflow path 56 therebetween. A spacer 58 is disposed between the inner member 52 and the outer member 54 and is provided with a series of nozzles 60 therethrough. The nozzles 60 continue the inflow path 56 from an annulus 106 between the screen 62 and the base pipe 42, through the ICDs 102, 104 and into the base pipe 42 via the apertures 53. At the ends of each ICD 102, 104 opposite to the screen 62 there is provided a sealing mechanism 108 to seal the gap between the outer member 54 and the inner member 52 so that fluid is only permitted to flow through each ICD 102, 106 and into base pipe 42 from the annulus 106.

As above, when a wellbore is producing, the production fluid will flow through the screen 62, along the annulus 106 between the screen 62 and the base pipe 42, through the nozzles 60 between the inner and outer members 52, 54 and through the apertures 53 into the base pipe 42. The production fluid will then flow to surface, co-mingling with production fluid which has passed through other ICDs at other locations on the completion.

Should the screen 62 ever become plugged with mud or other particulates, either prior to commencement of production or at a later point in the life of the well, it is possible to clean the flow control apparatus 100 by targeting one of the ICDs 102, 104 and delivering treatment fluid through the apertures 53 so that the treatment fluid is forced in reverse direction along the flow path 56 and along the annulus 106 to the other ICD 102, 104 before re-entering the base pipe 42 and flowing to the surface. Gradually pressure will build up along the annulus 106 and this will help to force the mud or other particulates outwardly from the screen 62 to thereby unblock the screen 62.

It will be appreciated by persons skilled in the art that various modifications may be made to the above embodiments without departing from the scope of the present invention. For example, embodiments of the invention may be utilised to deliver stimulation fluid to a wellbore section adjacent the apparatus. The fluid may be targeted to a specific well bore section.

The invention claimed is:

1. A method of cleaning a flow control apparatus in a wellbore comprising:

providing in a wellbore a flow control apparatus comprising a base pipe, at least one screen and at least one inflow control device, wherein a fluid inflow path is provided through the at least one screen and into and along a region between the base pipe and the screen and from an outer portion to an inner portion of the at least one inflow control device;

targeting the at least one inflow control device with a treatment fluid; and delivering the treatment fluid such that the fluid flows in a reverse direction along the fluid inflow path, wherein the step of targeting the at least one inflow control device comprises inserting a treatment tool into the wellbore for the delivery of the treatment fluid, and further comprising locating the treatment tool on a locator provided by the flow control apparatus, wherein the locator is configurable to permit the treatment tool to pass beyond the inflow control device.

2. The method according to claim 1, wherein the treatment fluid is delivered from an inner portion to an outer portion of a first inflow control device, along the screen, and then from an outer portion to an inner portion of a second inflow control device.

3. The method according to claim 2, including circulating the treatment fluid between the base pipe and the screen.

4. A method of treating a flow control apparatus in a wellbore, the method comprising:

running a treatment tool into downhole tubing incorporating a flow control apparatus comprising a base pipe, at least a first inflow control device and an associated screen;

locating the treatment tool adjacent the inflow control device;

locating the treatment tool on a locator provided by the flow control apparatus, wherein the locator is configurable to permit the treatment tool to pass beyond the inflow control device; and delivering treatment fluid through the treatment tool such that the treatment fluid flows through the inflow control into and along a region between the base pipe and the screen, and contacts the screen.

5. The method according to claim 4, further comprising engaging cooperating elements of the treatment tool and the flow control apparatus to locate the treatment tool relative to the flow control apparatus.

6. The method of claim 5, further comprising disengaging said cooperating elements and then translating the treatment tool axially through the tubing to engage cooperating elements of the treatment tool and a further flow control apparatus to locate the treatment tool relative to the further flow control apparatus, and then delivering treatment fluid through the treatment tool such that the treatment fluid flows through the further flow control device.

7. The method according to claim 4, comprising delivering the treatment fluid along a fluid treatment path extending from an inner portion to an outer portion of the first inflow control device and from an outer portion to an inner portion of a second inflow control device.

8. The method according to claim 7, including circulating the treatment fluid along the screen between the first and second inflow control devices.

9. A flow control apparatus for use in a wellbore, the flow control apparatus comprising:

a base pipe;

a screen;

a first inflow control device; and a second inflow control device; and a locating element configured to cooperate with a treatment tool for delivering treatment fluid through the first inflow control device, wherein the locating element is configurable to permit passage of the treatment tool beyond the first inflow control device, the apparatus providing a fluid inflow path through the screen, into and along a region between the base pipe and the screen and from an outer portion to an inner portion of each inflow control device, and the apparatus being configurable to provide a treatment fluid path extending from an inner portion to an outer portion of the first inflow control device, along the screen, and then from an outer portion to an inner portion of the second inflow control device.

10. The flow control apparatus according to claim 9, wherein the first inflow control device is provided at one end of the screen and the second inflow control device is provided at an opposite end of the screen.

11. The flow control apparatus according to claim 9, wherein the locating element comprises at least one of a recess, an inwardly projecting ledge, a shoulder, and a projection on which the treatment tool can be located.

12. The flow control apparatus according to claim 9, further comprising a first packer configurable to seal an annulus between the apparatus and the surrounding wellbore in a region beyond a first end of the screen and a second packer configurable to seal the annulus between the apparatus and the surrounding wellbore in a region beyond an opposite end of the screen.

13. A system for cleaning a flow control apparatus in a wellbore comprising:

the flow control apparatus according to claim 9; and a treatment tool comprising: an inlet for treatment fluid to flow into the tool; an outlet for treatment fluid to flow out of the tool; and a treatment tool locating element configured for cooperating with an inflow control device and providing for alignment of the outlet with the inflow control device, wherein the treatment tool locating element is configurable to permit the treatment tool to pass beyond the inflow control device.

14. The system of claim 13, wherein the treatment tool locating element comprises at least one of a recess, an outwardly projecting flange, shoulder and a projection.

15. The system of claim 13, wherein at least one of:

the flow control apparatus comprises a locating element configured to cooperate with the treatment tool;

the flow control apparatus comprises a locating element configured to cooperate with the treatment tool, the locating element comprising at least one of a recess, an inwardly projecting ledge, a shoulder, and a projection on which the treatment tool can be located;

the flow control apparatus comprises a locating element configured to cooperate with the treatment tool, the locating element configurable to permit passage of the treatment tool beyond the first inflow control device.

16. A treatment tool for use with the flow control apparatus according to claim 11, the treatment tool comprising:

an inlet for treatment fluid to flow into the tool;

an outlet for treatment fluid to flow out of the tool; and a treatment tool locating element configured for cooperating with an inflow control device and providing for alignment of the outlet with the inflow control device, wherein the treatment tool locating element is configurable to permit the treatment tool to pass beyond the inflow control device.

17. The treatment tool according to claim 16, wherein the treatment tool locating element comprises at least one of a recess, an outwardly projecting flange, shoulder, and a projection.

* * * * *